US008976971B2

(12) United States Patent
Zhang et al.

(10) Patent No.: US 8,976,971 B2
(45) Date of Patent: Mar. 10, 2015

(54) METHOD AND APPARATUS FOR ADJUSTING CHANNEL DELAY PARAMETER OF MULTI-CHANNEL SIGNAL

(75) Inventors: Libin Zhang, Beijing (CN); Qi Zhang, Beijing (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 758 days.

(21) Appl. No.: 13/277,851

(22) Filed: Oct. 20, 2011

(65) Prior Publication Data

US 2012/0033770 A1 Feb. 9, 2012

Related U.S. Application Data

(63) Continuation of application No. PCT/CN2010/071907, filed on Apr. 20, 2010.

(30) Foreign Application Priority Data

Apr. 20, 2009 (CN) ..... 2009 1 0082270

(51) Int. Cl.

| | |
|---|---|
| ***H04R 5/00*** | (2006.01) |
| ***H04S 3/00*** | (2006.01) |
| ***G10L 19/008*** | (2013.01) |
| ***G10L 21/02*** | (2013.01) |

(52) U.S. Cl.

CPC ..... *H04S 3/00* (2013.01); *G10L 19/008* (2013.01); *G10L 21/0205* (2013.01); *H04S 2400/03* (2013.01); *H04S 2420/03* (2013.01)

USPC ..... 381/23; 381/20; 704/500

(58) Field of Classification Search

CPC ..... H04S 2400/03; G10L 19/008

USPC ..... 700/94

See application file for complete search history.

(56) References Cited

U.S. PATENT DOCUMENTS

| | | | |
|---|---|---|---|
| 4,430,527 | A | 2/1984 | Eberbach |
| 2004/0138876 | A1 | 7/2004 | Kallio et al. |
| 2006/0029239 | A1 | 2/2006 | Smithers |

(Continued)

FOREIGN PATENT DOCUMENTS

| | | | |
|---|---|---|---|
| CN | 1926607 | A | 3/2007 |
| CN | 101111884 | A | 1/2008 |

(Continued)

OTHER PUBLICATIONS

Written Opinion of the International Searching Authority issued in corresponding PCT Patent Application No. PCT/CN2010/071907, mailed Jul. 22, 2010.

(Continued)

*Primary Examiner* — Joseph Saunders, Jr.

(74) *Attorney, Agent, or Firm* — Brinks Gilson & Lione

(57) ABSTRACT

A method and an apparatus for adjusting a channel delay parameter of a multi-channel signal are provided in the embodiments of the present invention. The method includes: performing down-mixing processing on a multi-channel signal to obtain a processed signal (101); calculating energy distribution of the processed signal (102); and judging whether a comb filtering effect occurs in the processed signal according to the energy distribution of the processed signal, and adjusting a channel delay parameter of the multi-channel signal if the comb filtering effect occurs in the processed signal (103).

25 Claims, 2 Drawing Sheets

(56) References Cited

U.S. PATENT DOCUMENTS

| | | | |
|---|---|---|---|
| 2006/0098827 | A1 | 5/2006 | Paddock et al. |
| 2007/0121952 | A1 | 5/2007 | Engdegard et al. |
| 2007/0127729 | A1 | 6/2007 | Breebaart et al. |
| 2008/0031463 | A1 | 2/2008 | Davis |

FOREIGN PATENT DOCUMENTS

| | | | |
|---|---|---|---|
| CN | 101533641 | A | 9/2009 |
| CN | 101673545 | A | 3/2010 |
| CN | 101673548 | A | 3/2010 |
| JP | 2004325633 | A | 11/2004 |
| JP | 2005529520 | A | 9/2005 |
| JP | 2007219542 | A | 8/2007 |
| JP | 2008509600 | A | 3/2008 |
| JP | 2008203315 | A | 9/2008 |
| WO | WO 2006/089570 | A1 | 8/2006 |
| WO | WO 2007/109338 | A1 | 9/2007 |
| WO | WO 2008065487 | A1 | 6/2008 |
| WO | WO 2010121536 | A1 | 10/2010 |

OTHER PUBLICATIONS

AFB—Audio for Broadcast, Prosoundnewseurope.com, Mar. 2007, pp. 25, 26, and 28.

Office Action issued in corresponding Japanese Patent Application No. 2012-506321, mailed Feb. 26, 2013.

Extended European Search Report issued in corresponding European Patent Application No. 10766626.5, mailed Aug. 29, 2012.

International Search Report issued in corresponding PCT Patent Application No. PCT/CN2010/071907, mailed Jul. 22, 2010.

Notice of Allowance issued in corresponding Japanese Patent Application No. 2012-506321, mailed Jun. 25, 2013, 4 pages.

Office Action issued in corresponding Chinese Patent Application No. 201110204951.7, mailed Feb. 26, 2013.

Search Report issued in corresponding Chinese Patent Application No. 201110204951.7, mailed Feb. 26, 2013.

METHOD AND APPARATUS FOR ADJUSTING CHANNEL DELAY PARAMETER OF MULTI-CHANNEL SIGNAL

CROSS-REFERENCE TO RELATED APPLICATIONS

This application is a continuation of International Application No. PCT/CN2010/071907, filed on Apr. 20, 2010, which claims priority to Chinese Patent Application No. 200910082270.0, filed on Apr. 20, 2009, both of which are hereby incorporated by reference in their entireties.

FIELD OF THE INVENTION

The present invention relates to the field of communications technologies, and in particular, to a method and an apparatus for adjusting a channel delay parameter of a multi-channel signal.

BACKGROUND OF THE INVENTION

A multi-channel signal is widely applied to various scenarios, such as a telephone conference and a game, and more and more emphasis is put on encoding/decoding of the multi-channel signal. When encoding the multi-channel signal, conventional encoders based on waveform encoding, such as Moving Pictures Experts Group (MPEG)-L II, Moving Picture Experts Group Audio Layer III (mp 3) and Advanced Audio Coding (AAC), all independently encode each channel. This encoding method may well restore the multi-channel signal, but the required bandwidth and encoding code rate are several times of those for a mono-channel signal.

The stereo or multi-channel encoding technology is parameter stereo encoding, which may reestablish a multi-channel signal whose acoustic feeling is completely the same as that for the original signal by utilizing a little bandwidth. The basic idea of the parameter stereo encoding is as follows. At an encoding end, a multi-channel signal is down-mixed into a mono-channel signal, and the mono-channel signal is independently encoded, meanwhile channel parameters between channels are extracted, and then these channel parameters are encoded. At a decoding end, firstly the down-mixed mono-channel signal is decoded, then the channel parameters between the channels are decoded, and finally these channel parameters together with the down-mixed mono-channel signal are utilized to synthesize a multi-channel signal.

In the parameter stereo encoding, channel parameters generally used for describing interrelations between channels include an inter-channel time difference parameter (that is, channel delay parameter), an inter-channel amplitude difference parameter and an inter-channel correlation parameter. The channel delay parameter represents a delay relationship between channels, and plays an important role of positioning the location of a speaker.

Taking a stereo signal as an example, a solution for transmitting a multi-channel signal in the prior art is as follows: a channel delay parameter between a left channel and a right channel is extracted by utilizing a correlation between the stereo left channel signal and the stereo right channel signal, and at the encoding end, delay adjustment is performed on the left/right channel signals of the stereo signal, which needs to be transmitted, by utilizing the channel delay parameter, thereby eliminating the delay difference between the two channels. Then, the left/right channel signals, which are obtained after the delay adjustment, are added in the time domain to obtain a down-mixed M signal (sum signal), and the left/right channel signals, which are obtained after the delay adjustment, are subtracted from each other in the time domain to obtain a down-mixed S signal (edge signal).

Then, according to the M signal and the S signal, other channel parameters are extracted, such as an energy ratio between the left channel and the right channel or an inter-channel amplitude difference parameter. At the encoding end, the channel parameters are encoded for transmission, and the M signal is encoded for transmission in the mono-channel manner. At the decoding end, firstly an M signal is reconstructed, and then according to the received channel delay parameter, a delay operation reverse to that for the encoding end is performed on each channel of the M signal, so as to reconstruct the transmitted stereo signal. Therefore, on the basis of transmitting a mono-channel signal, as long as a few code rate resources are provided to transmit channel parameters, a stereo signal may be reconstructed at the decoding end.

In the implementation of the present invention, the inventors find that at least the following problems exist in the prior art. In the prior art, a comb filtering effect may occur in a processed signal that is obtained after down-mixing processing (including: an M signal and an S signal), that is, a signal frequency domain amplitude in some particular frequency bands of at least one of the M signal and the S signal is greatly attenuated, and a signal frequency domain amplitude in some particular frequency bands is strengthened. The comb filtering effect deteriorates the quality of the processed signal, thereby affecting the quality of the reconstructed multi-channel signal.

SUMMARY OF THE INVENTION

Embodiments of the present invention provide a method and an apparatus for adjusting a channel delay parameter of a multi-channel signal, so as to alleviate a phenomenon that undesirable quality of a processed signal is caused due to a comb filtering effect.

An embodiment of the present invention provides a method for adjusting a channel delay parameter of a multi-channel signal, which includes:

performing down-mixing processing on a multi-channel signal to obtain a processed signal;

calculating energy distribution of the processed signal; and judging whether a comb filtering effect occurs in the processed signal according to the energy distribution of the processed signal, and adjusting a channel delay parameter of the multi-channel signal if the comb filtering effect occurs in the processed signal.

An embodiment of the present invention provides an apparatus for adjusting a channel delay parameter of a multi-channel signal, which includes:

a down-mixing processing module, configured to perform down-mixing processing on a multi-channel signal to obtain a processed signal;

an energy distribution obtaining module, configured to calculate energy distribution of the processed signal;

a judgment module, configured to judge whether a comb filtering effect occurs in the processed signal according to the energy distribution of the processed signal; and a channel delay parameter adjusting module, configured to adjust a channel delay parameter of the multi-channel signal if the judgment module judges that the comb filtering effect occurs in the processed signal.

It may be seen from the technical solutions according to the embodiments of the present invention that, in the embodiments of the present invention, according to the energy distribution of the processed signal that is obtained after the down-mixing processing is performed on the multi-channel signal, whether the comb filtering effect occurs is judged, and after it is determined that the comb filtering effect occurs, the channel delay parameter of the multi-channel signal is adjusted, so that the comb filtering effect may be alleviated, thereby improving the audio-video quality and the definition of the reconstructed multi-channel signal.

BRIEF DESCRIPTION OF THE DRAWINGS

To illustrate the technical solutions according to the embodiments of the present invention more clearly, the accompanying drawings for describing the embodiments are introduced briefly in the following. Apparently, the accompanying drawings in the following description are only some embodiments of the present invention, and persons of ordinary skill in the art can derive other drawings from the accompanying drawings without creative efforts.

DETAILED DESCRIPTION OF THE EMBODIMENTS

To make the embodiments of the present invention more comprehensible, the embodiments of the present invention is further illustrated in the following with reference to the accompanying drawings and several specific embodiments, and the embodiments are not intended to limit the scope of the present invention.

Figure 1:
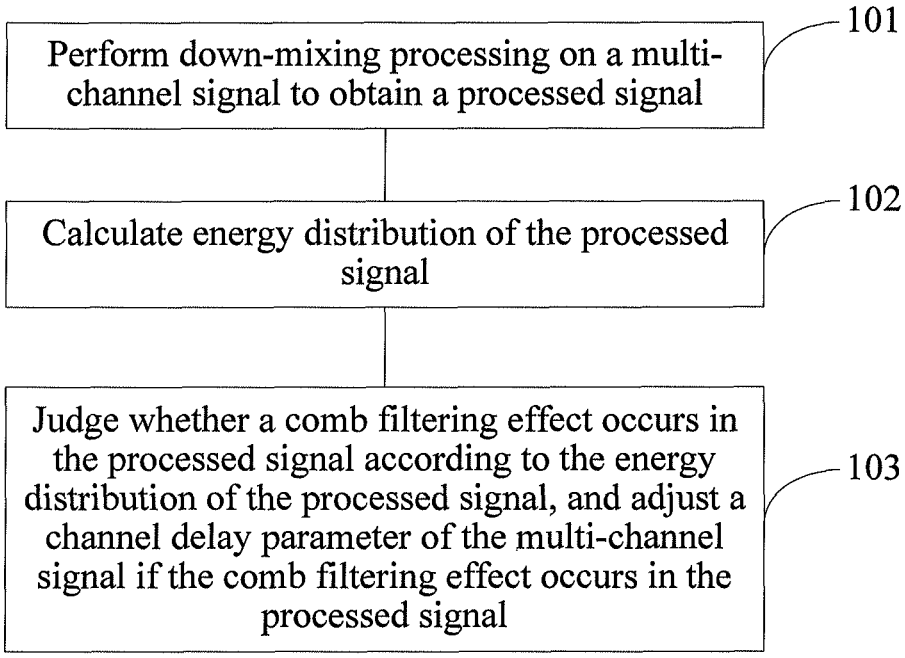
FIG. 1 is a processing flowchart of a method for adjusting a channel delay parameter of a multi-channel signal according to Embodiment 1 of the present invention.

An embodiment of the present invention provides a method for adjusting a channel delay parameter of a multi-channel signal, and as shown in FIG. 1, the method includes the following steps.

Step 101: Perform down-mixing processing on a multi-channel signal to obtain a processed signal.

Step 102: Calculate energy distribution of the processed signal.

Step 103: Judge whether a comb filtering effect occurs in the processed signal according to the energy distribution of the processed signal, and adjust a channel delay parameter of the multi-channel signal if the comb filtering effect occurs in the processed signal.

During specific implementation of the embodiment of the present invention, the down-mixing processing is performed on the multi-channel signal to obtain the processed signal, and the processed signal includes an M signal and an S signal. Persons skilled in the art may understand that, the comb filtering effect occurring in the processed signal includes any one of the following: the comb filtering effect occurs in the M signal; the comb filtering effect occurs in the S signal; and the comb filtering effect occurs in both the M signal and the S signal.

In the embodiment of the present invention, according to the energy distribution of the processed signal that is obtained after the down-mixing processing is performed on the multi-channel signal, whether the comb filtering effect occurs is judged, and after it is determined that the comb filtering effect occurs, the channel delay parameter of the multi-channel signal is adjusted, so that the comb filtering effect may be alleviated, thereby improving the audio-video quality and the definition of the reconstructed multi-channel signal. It should be noted that, when the present invention is specifically implemented, generally the comb filtering effect may be eliminated by adopting the solution of the present invention.

An embodiment of a specific application scenario is illustrated below. For convenience of description, the embodiment of the present invention is described by uniformly using stereo (a left channel and a right channel) in the following, but it should be clearly noted that, the embodiment of the present invention is not limited to the stereo, and is also applicable to other multiple channels.

When input signals include a multi-channel signal of more than two channels instead of a stereo signal of the left channel and the right channel only, the multi-channel signal may be converted into a stereo signal, and a specific conversion formula is as follows:

$$\begin{bmatrix} l_t(i) \\ r_t(i) \end{bmatrix} = \begin{bmatrix} 1 & 0 & \frac{1}{\sqrt{2}} & -j\sqrt{\frac{2}{3}} & -j\sqrt{\frac{1}{3}} \\ 0 & 1 & \frac{1}{\sqrt{2}} & j\sqrt{\frac{1}{3}} & j\sqrt{\frac{2}{3}} \end{bmatrix} \begin{bmatrix} l_f(i) \\ r_f(i) \\ c(i) \\ l_s(i) \\ r_s(i) \end{bmatrix}.$$

In the above formula, $l_f$, $r_f$, c, $l_s$, and $r_s$ are 5.1 channel signals, and $l_t$ and $r_t$ are stereo signals after conversion is performed.

Embodiment 1

Figure 2:
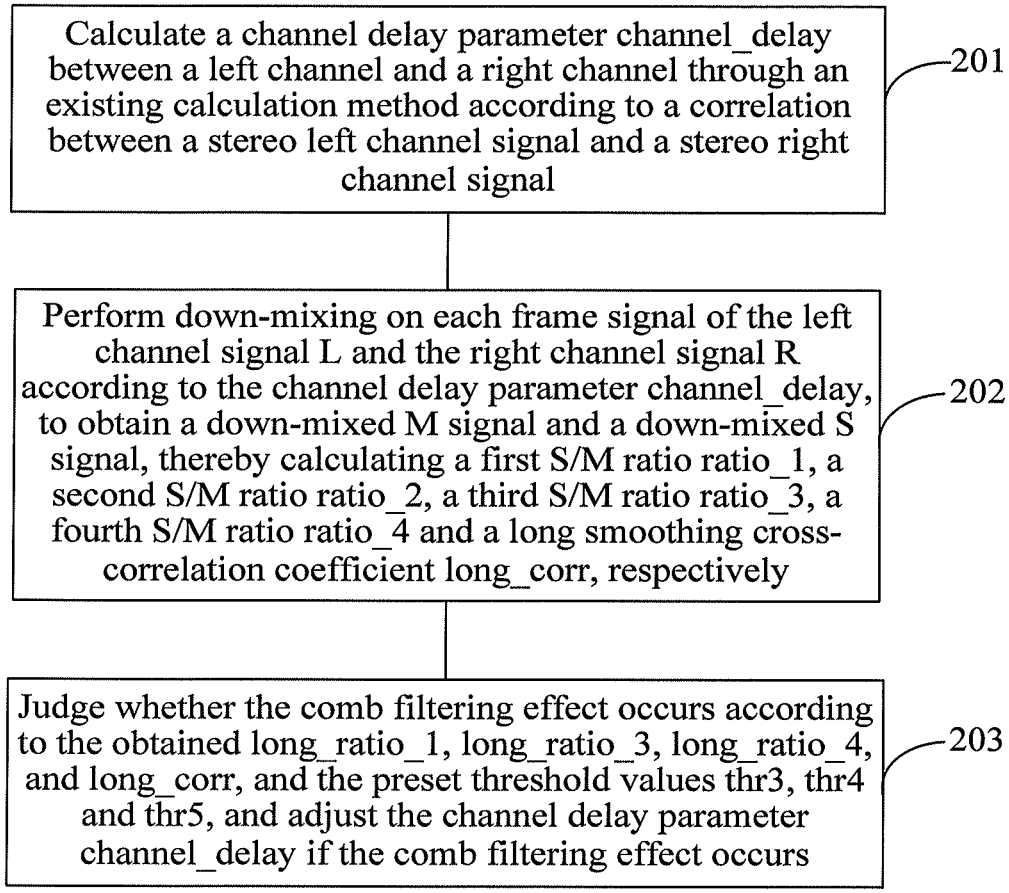
FIG. 2 is a processing flowchart of another method for adjusting a channel delay parameter of a multi-channel signal according to Embodiment 1 of the present invention.

A processing flow of a method for adjusting a channel delay parameter of a multi-channel signal according to the embodiment is shown in FIG. 2, and includes the following steps.

In this embodiment, input signals are a stereo left channel time domain signal $L_k\{l_1, l_2, \ldots l_N\}$ and a stereo right channel time domain signal $R_k\{r_1, r_2, \ldots r_N\}$, where k denotes a $k^{th}$ frame, and N denotes that a frame of signals has N sampling points.

Step 201: Calculate a channel delay parameter channel_delay between a left channel and a right channel that are corresponding to a current frame, according to a correlation between a stereo left channel signal and a stereo right channel signal.

Step 202: Perform down-mixing on a current frame signal of the left channel signal L and the right channel signal R according to the channel delay parameter channel_delay, to obtain a processed signal (an M signal and an S signal), thereby calculating a first S/M ratio ratio_1, a second S/M ratio ratio_2, a third S/M ratio ratio_3, a fourth S/M ratio ratio_4 and a long smoothing cross-correlation coefficient long_corr, respectively.

According to the channel delay parameter channel_delay, down-mixing is performed on each frame signal of the left channel signal L and the right channel signal R through the following formula 1, to obtain a down-mixed M signal and a down-mixed S signal, and the specific calculating method is as follows:

$$M(k)=(L(k+\text{delay})+R(k))/2$$

$$S(k)=(L(k+\text{delay})-R(k))/2 \qquad \text{Formula 1.}$$

In Formula 1, delay =channel_delay, and k denotes a $k^{th}$ frame.

The M signal and the S signal of the current frame include each sampling point, so the $M_{(k)}$ and the $S_{(k)}$ may be expressed as $M_k\{m_1, m_2, \ldots m_N\}$ and $S_k\{S_1, S_2, \ldots S_N\}$.

After the M signal and the S signal are obtained, in the embodiment of the present invention, energy distribution characteristics between the M signal and the S signal need to be obtained, and whether the comb filtering effect occurs in the processed signal obtained through the down-mixing processing is judged according to the energy distribution characteristics. It should be noted that, the inventors find that during the implementation of the present invention, the comb filtering effect may occur in the M signal or the S signal, or may occur in both the M signal and the S signal.

In practical application, the energy distribution characteristics between the M signal and the S signal may be denoted through an energy parameter ratio between the M signal and the S signal. Therefore, according to the $M_{(k)}$ and the $S_{(k)}$, a first S/M ratio ratio_1 (a first energy parameter ratio) is calculated, and the specific calculating method is as follows:

$$\text{ratio_1} = \sum_{i=1}^{N} s_i^2 \Big/ \sum_{i=1}^{N} m_i^2.$$

In the above formula, $$\sum_{i=1}^{N} s_i^2$$

denotes a superposed value of energy parameters of each sampling point in the S signal, $$\sum_{i=1}^{N} M_i^2$$

denotes a superposed value of energy parameters of each sampling point in the M signal, and the calculated ratio_1 denotes an energy parameter ratio between the S signal and the M signal.

Long smoothing is performed on the ratio_1 to obtain a first S/M ratio long_ratio_1 after the long smoothing, and the specific calculating method is as follows:

long_ratio__1=long_ratio__1'×scale1+ratio__1×(1−scale1).

The $_{long}$_ratio_1' on the right of the above formula denotes a long_ratio_1 corresponding to a previous frame. A value of the scale1 ranges from 0 to 1, that is, 0≤scale1 ≤1; if scale1=0, it is denoted that no smoothing is performed on these parameters, and in one embodiment, the value of the scale1 is 0.5.

Then, it is assumed that delay=0, a group of processed signals of $M'_k\{m'_1, m'_2, \ldots m'_N\}$, that is, a second sum signal, and $S'_k\{s'_1, s'_2, \ldots s'_N\}$, that is, a second edge signal are calculated according to Formula 1.

According to the $M'_k$ and the $S'_k$, a second S/M ratio ratio_2 (a second energy parameter ratio) is calculated, and the specific calculating method is as follows:

$$\text{ratio_2} = \sum_{i=1}^{N} s_i'^2 \Big/ \sum_{i=1}^{N} m_i'^2.$$

Long smoothing is performed on the ratio_2 to obtain a second S/M ratio long_ratio_2 after the long smoothing, and the specific calculating method is as follows:

long_ratio__2=long_ratio__2'×scale1+ratio__2×(1−scale1).

The long_ratio_2' on the right of the above formula denotes a long_ratio_2 corresponding to a previous frame.

Subsequently, according to the long_ratio_1 and the long_ratio_2, a third S/M ratio ratio_3 (a third energy parameter ratio) is calculated, and the specific calculating method is as follows:

ratio__3=long_ratio__1/long_ratio__2.

In practical application, the ratio_3 may be further calculated directly according to the ratio_1 and the ratio_2, and the specific calculating method is as follows:

ratio__3=ratio__1/ratio__2.

A floor parameter ratio_floor of the ratio_3 is calculated, and the specific calculating method is as follows:

$$\text{ratio_floor} = \sum_{i \in c} \text{ratio_3}(i),\ C = \{thr1 < \text{ratio_3} <= thr2\}.$$

In the above formula, the thr1 and the thr2 are comparative thresholds, in which a value of the thr1 range s from 0 to 3, and a value of the thr2 ranges from 0 to 10; if thr1=1 and thr2=1, it is denoted that the floor is not removed from the ratio_3 (because in this case, the value of ratio_floor is always 1), and in one embodiment, thr1=0 and thr2=1.

Floor removing processing is performed on the ratio_3, to obtain an energy ratio parameter ratio_4 (a fourth energy parameter ratio) whose signal energy distribution characteristics are more apparent, and the specific calculating method is as follows:

ratio__4=ratio__3/ratio_floor .

Long smoothing is performed on the ratio_4 to obtain a fourth S/M ratio long_ratio_4 after the long smoothing, and the specific calculating method is as follows:

long_ratio__4=long_ratio__4'×scale1+ratio__4×(1−scale1).

The long _ratio_4' on the right of the above formula denotes a long_ratio_4 corresponding to a previous frame.

Step 203: Judge whether the comb filtering effect occurs according to the obtained S/M ratios and the preset threshold values, and adjust the channel delay parameter channel_delay if the comb filtering effect occurs.

The long smoothing cross-correlation coefficient long_corr between the left channel and the right channel in a case of delay =0 is calculated, and the specific calculating method is as follows:

long_corr=long_corr'×scale2+cff (0)×(1−scale2).

The long_corr' on the right of the above formula is a long_corr corresponding to a previous frame, the ccf is a residual cross-correlation coefficient between a left channel and a right channel, and the specific calculating method is as follows:

$$ccf(i) = \left(\sum_{j=0}^{j+i<T} l_j^{res} \times r_{j+i}^{res}\right)^2 \Big/ \left(\sum_{j=0}^{j+i<T} l_j^{res2} + \sum_{j=0}^{j+i<T} r_{j+i}^{res2}\right),$$

$$i \in [-\text{MAX_OFFSET}, +\text{MAX_OFFSET}].$$

The MAX_OFFSET in the above formula is a constant, which is a preset possible maximal channel delay parameter, and generally, MAX_OFFSET=48; and T denotes that a frame of residual signals has T sampling points. In the above formula, the $l^{res}_i$ is a left channel residual time domain signal $L^{res}_k\{l^{res}_1, l^{res}_2, l^{res}_T\}$, and the $r^{res}_i$ is a right channel residual time domain signal $R^{res}_k\{r^{res}_1, r^{res}_2, \ldots r^{res}_T\}$.

Normalization processing may be further performed on the ccf, to obtain a normalization cross-correlation coefficient norm_ ccf, and the specific calculating method is as follows:

$$\text{norm_ccf}(i) = ccf(i) \Big/ \sum_{i=-MAX_OFFSET}^{i=+MAX_OFFSET} ccf(i).$$

A value of the scale2 ranges from 0 to 1, and in one embodiment, the value of the scale2 is 0.8.

According to the obtained ratio_1, long_ratio_1, ratio_3, long_ratio_4 and long_corr, and the preset determination threshold values thr3 (the first threshold value), thr4 (the second threshold value), thr5 (the third threshold value), thr6 (the fourth threshold value) and thr7 (the fifth threshold value), whether the comb filtering effect occurs is judged, and specific judging conditions include the following four types:

Condition 1: ratio_1>thr3 or long_ratio_1>thr4;

Condition 2: ratio_3>thr5 or long_ratio_4>thr6;

Condition 3: (ratio_1>thr3 or long_ratio_1>thr4) && (long_corr>thr7); and Condition 4: (ratio_3>thr5 or long_ratio_4>thr6) && (long_corr>thr7).

In the four conditions, the thr3, thr4, thr5, thr6 and thr7 are determination thresholds, and their value ranges are different from each other, in which values of the thr3 and the thr4 range from 1 to 100, for example, the values are 5; values of the thr5 and the thr6 range from 1 to 100, for example, the values are 10; and a value of the thr7 ranges from 0 to 1, for example, the value is 0.35.

If any one of the foregoing four conditions is satisfied, it may be considered that the comb filtering effect is detected. In this embodiment, when the comb filtering effect occurs, it is supposed that the down-mixed M signal is smaller than that in a normal case, while the S signal is relatively larger, or the correlation between the left channel and the right channel is large in a case without channel delay. Therefore, the channel delay parameter channel_delay needs to be adjusted, and it is assumed that a delay adjusting indication flag delay_change_flag=1; otherwise, delay_change_flag=0.

If the delay adjusting indication flag is 1, that is, delay_online_flag=1, the channel delay parameter may be indirectly adjusted through the following four adjusting methods. The main idea of the adjusting methods lies in that, a function value (that is, norm_ccf (0)) of the normalization cross-correlation coefficient norm_ccf at a location where delay=0 is increased to be greater than or maximally greater than function values at all locations where delay 0. By searching for the maximum value in the norm_ccf, delay i corresponding to the value is just the channel delay channel_delay, that is, delay=arg(max(norm_ccf (i))). Therefore, if the norm_ccf (0) is increased, the channel delay may be adjusted to 0.

Adjusting method 1: norm_ccf (0)=norm_ccf (0)+M , where M is a constant, and a value of M ranges from 0 to 10, for example, the value is 3.

Adjusting method 2: norm_ccf (0)=norm_ccf (0)×Q, where Q is a constant, and a value of Q ranges from 1 to 10000, for example, the value is 1000.

Adjusting method 3: norm_ccf (0)=norm_ccf (0)×Q1(long_ratio_4), where the amplification factor Q1(long_ratio_4) is a direct proportional function of the long_ratio_4, and the greater the long_ratio_4 is, the greater the function value is.

The expression of the function Q1(long_ratio_4) is

Q1(long_ratio_4)=q1×long_ratio_4+c1.

In the above expression, the value of the variable q1 ranges from 1 to 1000, for example, the value is 100. The value of the c1 ranges from 0 to 10, for example, the value is 0.

Adjusting method 4: norm_ccf (0)=norm_ccf (0)×Q2(long_ratio_1), where the amplification factor Q2(long_ratio_1) is a direct proportional function of the long_ratio_1, and the greater the long_ratio_1 is, the greater the function value is.

The expression of the function Q2(long _ratio_1) is:

Q2(long_ratio_1)=q2×long_ratio_1+c2.

In the above expression, the value of the variable q2 ranges from 1 to 1000, for example, the value is 100, and the value of the c2 ranges from 0 to 10, for example, the value is 0.

The norm_ccf(0) at either side of the equation in each of Adjusting methods 1, 2, 3 and 4 represents the same meaning, that is, the update for the value.

It should be noted that, preferably, the foregoing processing may be performed on the normalization cross-correlation coefficient norm_ccf, to achieve the objective of indirectly adjusting the channel delay parameter. Likewise, the same processing may also be performed on the cross-correlation coefficient ccf, to achieve the objective of indirectly adjusting the channel delay parameter; the specific processing manner is the same as the processing manner for the normalization cross-correlation coefficient norm_cc , and the details are not described herein again.

In practical application, if the delay adjusting indication flag is 1, that is, delay_change_flag=1, the channel delay parameter may further be adjusted directly, and the channel delay parameter is directly set to zero, that is, channel delay=0. The direct adjusting on the delay parameter may influence some parameters relevant to the delay parameter, thereby affecting performances of other parts of the encoding end. The indirect adjusting on the delay parameter may not cause the above impact, and the effect is better than that of the direct adjusting.

The embodiment may judge whether the comb filtering effect occurs in the down-mixed processed signal of the current frame, and may correspondingly adjust the channel delay parameter channel_delay in time if the comb filtering effect occurs, thereby eliminating the comb filtering effect, and ensuring the audio-video quality and the definition of the multi-channel signal such as the reconstructed stereo signal.

Embodiment 2

The difference between this embodiment and Embodiment 1 lies in that, the input signal adopted when the down-mixed M signal and the down-mixed S signal are calculated is a signal obtained after the original left channel signal and the original right channel signal are simply extracted.

In this embodiment, simple extraction processing is performed on the originally input stereo left channel time domain signal $L_k\{l_1, l_2, \ldots l_N\}$ and the originally input stereo right channel time domain signal $R_k\{r_1, r_2, \ldots r_N\}$, that is, down-sampling processing is performed, to obtain down-sampled signals $L'_k$, $\{l'_1, l'_2, \ldots l'_M\}$ and $R'_k$, $\{r'_1, r'_2, \ldots r'_M\}$, where M is the number of sampling points of a frame of signals after the extraction, and k denotes a $k^{th}$ frame. The down-sampling processing method is as follows:

$$l'_j = l_{N/M \times j}$$

$$r'_j = r_{N/M \times j}$$

Then, the down-sampled signals $L'_k\{l'_1, l'_2, \ldots l'_M\}$ and $R'_k\{r'_1, r'_2, \ldots r'_M\}$ are utilized to judge whether the comb filtering effect occurs according to the processing flow according to Embodiment 1, and correspondingly adjust the channel delay parameter channel_delay.

In this embodiment, down-sampling is performed on the originally input stereo left channel time domain signal and the originally input stereo right channel time domain signal, so that the number of sampled signals is reduced, and the amount of calculation is reduced, thereby improving the calculating speed of the first S/M ratio ratio_1, the second S/M ratio ratio_2, the third S/M ratio ratio_3, the fourth S/M ratio ratio_4 and the long smoothing cross-correlation coefficient long_corr.

Embodiment 3

In this embodiment, if it is detected that a channel delay parameter needs to be adjusted, that is, delay_change_flag=1 is detected in the frame, a tailing range is set, and channel delay parameters are adjusted for all frames in the tailing range after the frame, no matter whether these frames really satisfy a condition under which the comb filtering effect occurs, that is, delay adjusting indication flags of these frames are forced to be 1. Then, the channel delay parameters of these frames are adjusted by using the four indirect adjusting methods or the direct adjusting method according to Embodiment 1.

The frames of the tailing range may be set according to a practical case, for example, it is set that channel delay parameters of 100 frames after the frame are adjusted.

After the comb filtering effect occurs in the current frame, the possibility that the comb filtering effect continues to occur in a subsequent frame is also great. This embodiment is equivalent to setting an adjusted tailing of a channel delay parameter, and the benefit of setting the adjusted tailing is to ensure effectiveness and continuity of the delay adjusting as much as possible, and to prevent a problem that the comb filtering effect continues to occur in a subsequent frame.

Figure 3:
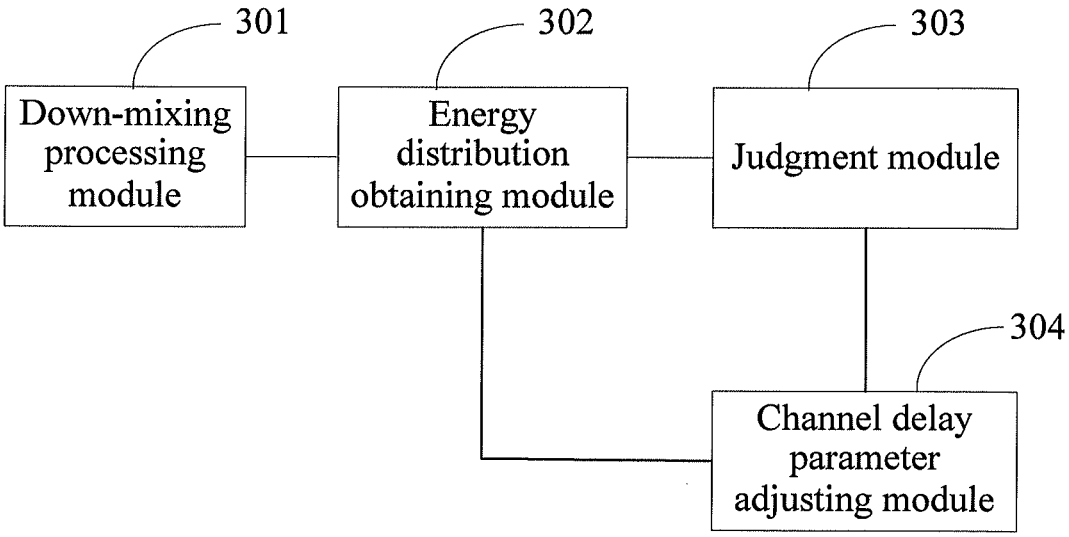
FIG. 3 is a structure diagram of specific implementation of an apparatus for adjusting a channel delay parameter of a multi-channel signal according to Embodiment 1 of the present invention.

An embodiment of the present invention further provides an apparatus for adjusting a channel delay parameter of a multi-channel signal, and a specific implementation structure of the apparatus is shown in FIG. 3. The apparatus includes:

A down-mixing processing module 301, configured to perform down-mixing processing on a multi-channel signal to obtain a processed signal.

An energy distribution obtaining module 302, configured to calculate energy distribution of the processed signal.

A judgment module 303, configured to judge whether a comb filtering effect occurs in the processed signal according to the energy distribution of the processed signal.

A channel delay parameter adjusting module 304, configured to adjust a channel delay parameter of the multi-channel signal if the judgment module judges that the comb filtering effect occurs in the processed signal.

Further, the down-mixing processing module 301 is configured to perform down-mixing processing on a current frame signal of the multi-channel signal to obtain a sum signal and an edge signal.

Alternatively, the down-mixing processing module 301 is configured to perform down-sampling on the current frame signal of the multi-channel signal, and perform down-mixing processing on a down-sampled signal obtained after the down-sampling to obtain a sum signal and an edge signal.

Furthermore, the down-mixing processing module 301 is configured to obtain a channel delay parameter of a current frame of the multi-channel signal, and perform down-mixing on the multi-channel signal according to the channel delay parameter of the current frame to obtain a down-mixed sum signal and a down-mixed edge signal.

The energy distribution obtaining module 302 is configured to divide a superposed value of energy parameters of each sampling point in the edge signal by a superposed value of energy parameters of each sampling point in the sum signal to obtain a first energy parameter ratio.

The judgment module 303 is configured to judge that the comb filtering effect occurs in the processed signal if the first energy parameter ratio is greater than a preset first threshold value.

Alternatively, the judgment module 303 is configured to judge that the comb filtering effect occurs in the processed signal if the first energy parameter ratio obtained after long smoothing processing is greater than a preset second threshold value.

Furthermore, the energy distribution obtaining module 302 is further configured to calculate a cross-correlation coefficient corresponding to zero delay of the multi-channel signal, and perform long smoothing processing to obtain a cross-correlation coefficient after the long smoothing processing.

The judgment module 303 is configured to judge that the comb filtering effect occurs in the processed signal if the cross-correlation coefficient obtained after the long smoothing processing is greater than a preset fifth threshold value, and the first energy parameter ratio is greater than the preset first threshold value; or the judgment module is configured to judge that the comb filtering effect occurs in the processed signal if the cross-correlation coefficient obtained after the long smoothing processing is greater than a preset fifth threshold value, and the first energy parameter ratio obtained after the long smoothing processing is greater than the preset second threshold value.

Furthermore, the down-mixing processing module 301 is configured to perform down-mixing on the multi-channel signal according to the channel delay parameter being zero, to obtain a down-mixed second sum signal and a down-mixed second edge signal.

The energy distribution obtaining module 302 is further configured to divide a superposed value of energy parameters of each sampling point in the second edge signal by a superposed value of energy parameters of each sampling point in the second sum signal to obtain a second energy parameter ratio, and divide the first energy parameter ratio by the second energy parameter ratio to obtain a third energy parameter ratio; or, perform long smoothing processing on the first energy parameter ratio and the second energy parameter ratio respectively, and divide the first energy parameter ratio, which is obtained after the long smoothing processing, by the second energy parameter ratio obtained after the long smoothing processing, to obtain a third energy parameter ratio.

The judgment module 303 is configured to judge that the comb filtering effect occurs in the processed signal if the third energy parameter ratio is greater than a preset third threshold value.

Furthermore, the energy distribution obtaining module 302 is configured to perform floor removing processing on the third energy parameter ratio, to obtain a fourth energy parameter ratio, and perform long smoothing processing on the fourth energy parameter ratio, to obtain the fourth energy parameter ratio that is obtained after the long smoothing processing.

The judgment module 303 is configured to judge that the comb filtering effect occurs in the processed signal if the fourth energy parameter ratio obtained after the long smoothing processing is greater than a preset fourth threshold value.

Furthermore, the energy distribution obtaining module 302 is further configured to calculate a cross-correlation coefficient corresponding to zero delay of the multi-channel signal, and perform long smoothing processing to obtain a cross-correlation coefficient after the long smoothing processing.

The judgment module 303 is configured to judge that the comb filtering effect occurs in the processed signal if the cross-correlation coefficient obtained after the long smoothing processing is greater than the preset fifth threshold value, and the third energy parameter ratio is greater than the preset third threshold value.

The judgment module 303 is configured to judge that the comb filtering effect occurs in the processed signal if the cross-correlation coefficient obtained after the long smoothing processing is greater than the preset fifth threshold value, and the fourth energy parameter ratio obtained after the long smoothing processing is greater than the preset fourth threshold value.

Specifically, the channel delay parameter adjusting module 304 is configured to set a channel delay parameter of a current frame of the multi-channel signal to zero; or, the channel delay parameter adjusting module 304 is configured to calculate a cross-correlation coefficient corresponding to zero delay of the multi-channel signal, and increase the cross-correlation coefficient corresponding to the zero delay; or, the channel delay parameter adjusting module 304 is configured to calculate a normalization cross-correlation coefficient corresponding to zero delay of the multi-channel signal, and increase the normalization cross-correlation coefficient corresponding to the zero delay.

Further, the channel delay parameter adjusting module 304 is configured to adjust a channel delay parameter of a frame in a tailing range after the current frame, after the channel delay parameter of the current frame signal of the multi-channel signal is adjusted.

To sum up, the embodiments of the present invention judge whether the comb filtering effect occurs according to the energy distribution of the processed signal obtained through the down-mixing processing, and the energy distribution may be denoted through the energy parameter ratio between the S signal and the M signal. If the comb filtering effect occurs, the channel delay parameter of the multi-channel signal is adjusted through various direct and indirect methods, thereby eliminating the comb filtering effect, and ensuring the audio-video quality and the definition of the multi-channel signal such as the reconstructed stereo signal.

Persons of ordinary skill in the art should understand that all or a part of the processes of the method according to the embodiments of the present invention may be implemented by a program instructing relevant hardware. The program may be stored in a computer readable storage medium. When the program runs, the processes of the method according to the embodiments of the present invention are performed. The storage medium may be a magnetic disk, an optical disk, a Read-Only Memory (ROM) or a Random Access Memory (RAM).

Although the present invention is described above with some exemplary embodiments, the protection scope of the present invention is not limited thereto. Various modifications and variations that can be easily derived by persons skilled in the art without departing from the technical scope of the present invention should fall within the protection scope of the present invention. Therefore, the protection scope of the present invention falls in the appended claims.

What is claimed is:

1. A method for adjusting a channel delay parameter of a multi-channel signal, comprising:

performing down-mixing processing on a multi-channel signal to obtain a processed signal, wherein the processed signal comprises a sum signal and a side signal;

calculating energy distribution of the processed signal;

judging whether a comb filtering effect occurs in the processed signal according to the energy distribution of the processed signal, and adjusting a channel delay parameter of the multi-channel signal if the comb filtering effect occurs in the processed signal; and wherein the performing the down-mixing processing on the multi-channel signal to obtain the processed signal comprises:

obtaining a channel delay parameter of a current frame of the multi-channel signal, and performing down-mixing on the multi-channel signal according to the channel delay parameter of the current frame to obtain a down-mixed sum signal and a down-mixed side signal; and the calculating the energy distribution of the processed signal comprises:

dividing a sum value of energy parameters of each sampling point in the side signal by a sum value of energy parameters of each sampling point in the sum signal to obtain a first energy parameter ratio.

2. The method according to claim 1, wherein the performing the down-mixing processing on the multi-channel signal to obtain the processed signal comprises:

performing down-mixing processing on a current frame signal of the multi-channel signal to obtain a sum signal and an side signal;

or, performing down-sampling on a current frame signal of the multi-channel signal, and performing down-mixing processing on a down-sampled signal, which is obtained after the down-sampling, to obtain a sum signal and an side signal.

3. The method according to claim 1, wherein the judging whether the comb filtering effect occurs in the processed signal according to the energy distribution of the processed signal comprises:

judging that the comb filtering effect occurs in the processed signal if the first energy parameter ratio is greater than a preset first threshold value; or judging that the comb filtering effect occurs in the processed signal if the first energy parameter ratio, which is obtained after long-term smoothing processing, is greater than a preset second threshold value.

4. The method according to claim 1, wherein the calculating the energy distribution of the processed signal further comprises:

calculating a cross-correlation coefficient corresponding to zero delay of the multi-channel signal, and performing long-term smoothing processing to obtain a cross-correlation coefficient after the long-term smoothing processing; and the judging whether the comb filtering effect occurs in the processed signal according to the energy distribution of the processed signal comprises:

judging that the comb filtering effect occurs in the processed signal, if the cross-correlation coefficient, which is obtained after the long-term smoothing processing, is greater than a preset fifth threshold value, and the first energy parameter ratio is greater than a preset first threshold value; or judging that the comb filtering effect occurs in the processed signal, if the cross-correlation coefficient, which is obtained after the long-term smoothing processing, is greater than a preset fifth threshold value, and the first energy parameter ratio obtained after the long-term smoothing processing is greater than a preset second threshold value.

5. The method according to claim 1, wherein the performing the down-mixing processing on the multi-channel signal to obtain the processed signal further comprises:

performing down-mixing on the multi-channel signal according to the channel delay parameter being zero, to obtain a down-mixed second sum signal and a down-mixed second side signal; and the calculating the energy distribution of the processed signal further comprises:

dividing a sum value of energy parameters of each sampling point in the second side signal by a sum value of energy parameters of each sampling point in the second sum signal to obtain a second energy parameter ratio; and dividing the first energy parameter ratio by the second energy parameter ratio, to obtain a third energy parameter ratio; or, performing long-term smoothing processing on the first energy parameter ratio and the second energy parameter ratio respectively, and dividing the first energy parameter ratio, which is obtained after the long-term smoothing processing, by the second energy parameter ratio obtained after the long-term smoothing processing, to obtain a third energy parameter ratio.

6. The method according to claim 5, wherein the judging whether the comb filtering effect occurs in the processed signal according to the energy distribution of the processed signal comprises:

judging that the comb filtering effect occurs in the processed signal if the third energy parameter ratio is greater than a preset third threshold value.

7. The method according to claim 5, wherein the calculating the energy distribution of the processed signal further comprises:

performing floor removing processing on the third energy parameter ratio, to obtain a fourth energy parameter ratio, and performing long-term smoothing processing on the fourth energy parameter ratio, to obtain the fourth energy parameter ratio after the long-term smoothing processing.

8. The method according to claim 7, wherein the judging whether the comb filtering effect occurs in the processed signal according to the energy distribution of the processed signal comprises:

judging that the comb filtering effect occurs in the processed signal if the fourth energy parameter ratio, which is obtained after the long-term smoothing processing, is greater than a preset fourth threshold value.

9. The method according to claim 7, wherein the calculating the energy distribution of the processed signal further comprises:

calculating a cross-correlation coefficient corresponding to zero delay of the multi-channel signal, and performing long-term smoothing processing to obtain a cross-correlation coefficient after the long-term smoothing processing; and the judging whether the comb filtering effect occurs in the processed signal according to the energy distribution of the processed signal comprises:

judging that the comb filtering effect occurs in the processed signal, if the cross-correlation coefficient, which is obtained after the long-term smoothing processing, is greater than a preset fifth threshold value, and the fourth energy parameter ratio, which is obtained after the long-term smoothing processing, is greater than a preset fourth threshold value.

10. The method according to claim 5, wherein the calculating the energy distribution of the processed signal further comprises:

calculating a cross-correlation coefficient corresponding to zero delay of the multi-channel signal, and performing long-term smoothing processing to obtain a cross-correlation coefficient after the long-term smoothing processing; and the judging whether the comb filtering effect occurs in the processed signal according to the energy distribution of the processed signal comprises:

judging that the comb filtering effect occurs in the processed signal, if the cross-correlation coefficient, which is obtained after the long-term smoothing processing, is greater than a preset fifth threshold value, and the third energy parameter ratio is greater than a preset third threshold value.

11. The method according to claim 1, wherein the adjusting the channel delay parameter of the multi-channel signal comprises:

setting the channel delay parameter of a current frame of the multi-channel signal to zero; or calculating a cross-correlation coefficient corresponding to zero delay of the multi-channel signal, and increasing the cross-correlation coefficient corresponding to the zero delay; or calculating a normalization cross-correlation coefficient corresponding to zero delay of the multi-channel signal, and increasing the normalization cross-correlation coefficient corresponding to the zero delay.

12. The method according to claim 11, wherein the increasing the cross-correlation coefficient corresponding to the zero delay comprises:

adding a constant to the cross-correlation coefficient corresponding to the zero delay; or multiplying the cross-correlation coefficient corresponding to the zero delay by a constant; or multiplying the cross-correlation coefficient corresponding to the zero delay by an amplification factor, wherein the amplification factor is obtained according to the energy distribution of the processed signal.

13. The method according to claim 1, further comprising:

adjusting a channel delay parameter of a frame in a tailing range after the current frame, after the channel delay parameter of the current frame signal of the multi-channel signal is adjusted.

14. An apparatus for adjusting a channel delay parameter of a multi-channel signal, comprising:

a down-mixing processing module, configured to perform down-mixing processing on a multi-channel signal to obtain a processed signal, wherein the processed signal comprises a sum signal and a side signal;

an energy distribution obtaining module, configured to calculate energy distribution of the processed signal;

a judgment module, configured to judge whether a comb filtering effect occurs in the processed signal according to the energy distribution of the processed signal;

a channel delay parameter adjusting module, configured to adjust a channel delay parameter of the multi-channel signal if the judgment module judges that the comb filtering effect occurs in the processed signal; and wherein the down-mixing processing module is configured to obtain a channel delay parameter of a current frame of the multi-channel signal, and perform down-mixing on the multi-channel signal according to the channel delay parameter of the current frame to obtain a down-mixed sum signal and a down-mixed side signal; and the energy distribution obtaining module is configured to divide a sum value of energy parameters of each sampling point in the side signal by a sum value of energy parameters of each sampling point in the sum signal to obtain a first energy parameter ratio.

15. The apparatus according to claim 14, wherein the down-mixing processing module is configured to perform down-mixing processing on a current frame signal of the multi-channel signal to obtain a sum signal and an side signal;

or, the down-mixing processing module is configured to perform down-sampling on a current frame signal of the multi-channel signal, and perform down-mixing processing on a down-sampled signal, which is obtained after the clown-sampling, to obtain a sum signal and an side signal.

16. The apparatus according to claim 14, wherein the judgment module is configured to judge that the comb filtering effect occurs in the processed signal if the first energy parameter ratio is greater than a preset first threshold value; or the judgment module is configured to judge that the comb filtering effect occurs in the processed signal if the first energy parameter ratio, which is obtained after long-term smoothing processing, is greater than a preset second threshold value.

17. The apparatus according to claim 14, wherein the energy distribution obtaining module is further configured to calculate a cross-correlation coefficient corresponding to zero delay of the multi-channel signal, and perform long-term smoothing processing to obtain a cross-correlation coefficient after the long-term smoothing processing; and the judgment module is configured to judge that the comb filtering effect occurs in the processed signal, if the cross-correlation coefficient, which is obtained after the long-term smoothing processing, is greater than a preset fifth threshold value, and the first energy parameter ratio is greater than a preset first threshold value; or the judgment module is configured to judge that the comb filtering effect occurs in the processed signal, if the cross-correlation coefficient, which is obtained after the long-term smoothing processing, is greater than a preset fifth threshold value, and the first energy parameter ratio, which is obtained after the long-term smoothing processing, is greater than a preset second threshold value.

18. The apparatus according to claim 14, wherein the down-mixing processing module is further configured to perform down-mixing on the multi-channel signal according to the channel delay parameter being zero, to obtain a down-mixed second sum signal and a down-mixed second side signal; and the energy distribution obtaining module is further configured to divide a sum value of energy parameters of each sampling point in the second side signal by a sum value of energy parameters of each sampling point in the second sum signal to obtain a second energy parameter ratio, and divide the first energy parameter ratio by the second energy parameter ratio, to obtain a third energy parameter ratio; or, perform long-term smoothing processing on the first energy parameter ratio and the second energy parameter ratio respectively, and divide the first energy parameter ratio, which is obtained after the long-term smoothing processing, by the second energy parameter ratio obtained after the long-term smoothing processing, to obtain a third energy parameter ratio.

19. The apparatus according to claim 18, wherein the judgment module is configured to judge that the comb filtering effect occurs in the processed signal if the third energy parameter ratio is greater than a preset third threshold value.

20. The apparatus according to claim 18, wherein the energy distribution obtaining module is further configured to perform floor removing processing on the third energy parameter ratio, to obtain a fourth energy parameter ratio, and perform long-term smoothing processing on the fourth energy parameter ratio, to obtain the fourth energy parameter ratio after the long-term smoothing processing.

21. The apparatus according to claim 20, wherein the judgment module is configured to judge that the comb filtering effect occurs in the processed signal if the fourth energy parameter ratio, which is obtained after the long-term smoothing processing, is greater than a preset fourth threshold value.

22. The apparatus according to claim 20, wherein the energy distribution obtaining module is further configured to calculate a cross-correlation coefficient corresponding to zero delay of the multi-channel signal, and perform long-term smoothing processing to obtain a cross-correlation coefficient after the long-term smoothing processing; and the judgment module is configured to judge that the comb filtering effect occurs in the processed signal, if the cross-correlation coefficient, which is obtained after the long-term smoothing processing, is greater than a preset fifth threshold value, and the fourth energy parameter ratio, which is obtained after the long-term smoothing processing, is greater than a preset fourth threshold value.

23. The apparatus according to claim 18, wherein the energy distribution obtaining module is further configured to calculate a cross-correlation coefficient corresponding to zero delay of the multi-channel signal, and perform long-term smoothing processing to obtain a cross-correlation coefficient after the long-term smoothing processing; and the judgment module is configured to judge that the comb filtering effect occurs in the processed signal, if the cross-correlation coefficient, which is obtained after the long-term smoothing processing, is greater than a preset fifth threshold value, and the third energy parameter ratio is greater than a preset third threshold value.

24. The apparatus according to claim 14, wherein the channel delay parameter adjusting module is configured to set a channel delay parameter of a current frame of the multi-channel signal to zero; or, the channel delay parameter adjusting module is configured to calculate a cross-correlation coefficient corresponding to zero delay of the multi-channel signal, and increase the cross-correlation coefficient corresponding to the zero delay; or, the channel delay parameter adjusting module is configured to calculate a normalization cross-correlation coefficient corresponding to zero delay of the multi-channel signal, and increase the normalization cross-correlation coefficient corresponding to the zero delay.

25. The apparatus according to claim 14, wherein the channel delay parameter adjusting module is further configured to adjust a channel delay parameter of a frame in a tailing range after the current frame, after the channel delay parameter of the current frame signal of the multi-channel signal is adjusted.

* * * * *